US008280724B2

(12) United States Patent
Chazan et al.

(10) Patent No.: US 8,280,724 B2
(45) Date of Patent: Oct. 2, 2012

(54) SPEECH SYNTHESIS USING COMPLEX SPECTRAL MODELING

(75) Inventors: Dan Chazan, Haifa (IL); Ron Hoory, Haifa (IL); Zvi Kons, Yokne'am Ilit (IL); Slava Shechtman, Haifa (IL); Alexander Sorin, Haifa (IL)

(73) Assignee: Nuance Communications, Inc., Burlington, MA (US)

( * ) Notice: Subject to any disclaimer, the term of this patent is extended or adjusted under 35 U.S.C. 154(b) by 1335 days.

(21) Appl. No.: 11/046,911

(22) Filed: Jan. 31, 2005

(65) Prior Publication Data

US 2005/0131680 A1 Jun. 16, 2005

Related U.S. Application Data

(63) Continuation-in-part of application No. 10/243,580, filed on Sep. 13, 2002, now Pat. No. 7,127,389.

(51) Int. Cl.

| | |
|---|---|
| ***G10L 11/04*** | (2006.01) |
| ***G10L 19/14*** | (2006.01) |
| ***G10L 11/06*** | (2006.01) |
| ***G10L 19/06*** | (2006.01) |

(52) U.S. Cl. ..... 704/206; 704/205; 704/207; 704/208; 704/209

(58) Field of Classification Search ..... 704/214–215, 704/205–209

See application file for complete search history.

(56) References Cited

U.S. PATENT DOCUMENTS

| | | | | |
|---|---|---|---|---|
| 5,046,100 | A * | 9/1991 | Thomson | 704/214 |
| 5,152,007 | A * | 9/1992 | Uribe | 455/116 |
| 5,649,055 | A * | 7/1997 | Gupta et al. | 704/233 |
| 5,799,276 | A * | 8/1998 | Komissarchik et al. | 704/251 |
| 5,893,058 | A * | 4/1999 | Kosaka | 704/254 |
| 5,933,801 | A * | 8/1999 | Fink et al. | 704/208 |
| 6,014,617 | A * | 1/2000 | Kawahara | 704/207 |
| 6,144,939 | A * | 11/2000 | Pearson et al. | 704/258 |
| 6,233,550 | B1 * | 5/2001 | Gersho et al. | 704/208 |
| 6,240,381 | B1 * | 5/2001 | Newson | 704/214 |
| 6,249,757 | B1 * | 6/2001 | Cason | 704/214 |
| 6,304,842 | B1 * | 10/2001 | Husain et al. | 704/214 |
| 6,385,570 | B1 * | 5/2002 | Kim | 704/200 |

(Continued)

FOREIGN PATENT DOCUMENTS

JP 2000-181472 6/2000

OTHER PUBLICATIONS

Okawa, S.; Kobayashi, T.; Shirai, K., "Automatic training of phoneme dictionary based on mutual information criterion," Acoustics, Speech, and Signal Processing, 1994. ICASSP-94., 1994 IEEE International Conference on , vol. i, no., pp. I/241-I/244 vol. 1, Apr. 19-22, 1994.*

(Continued)

*Primary Examiner* — Pierre-Louis Desir

*Assistant Examiner* — Matthew Baker

(74) *Attorney, Agent, or Firm* — Wolf, Greenfield & Sacks, P.C.

(57) ABSTRACT

A method for processing a speech signal includes dividing the speech signal into a succession of frames, identifying one or more of the frames as click frames, and extracting phase information from the click frames. The speech signal is encoded using the phase information. Methods are also provided for modeling phase spectra of voiced frames and click frames.

15 Claims, 7 Drawing Sheets

U.S. PATENT DOCUMENTS

| | | | | |
|---|---|---|---|---|
| 6,397,175 | B1 * | 5/2002 | Manjunath | 704/207 |
| 6,453,287 | B1 * | 9/2002 | Unno et al. | 704/219 |
| 6,475,245 | B2 * | 11/2002 | Gersho et al. | 704/208 |
| RE38,269 | E * | 10/2003 | Liu | 704/227 |
| 6,665,641 | B1 * | 12/2003 | Coorman et al. | 704/260 |
| 6,678,649 | B2 * | 1/2004 | Manjunath | 704/207 |
| 6,804,649 | B2 * | 10/2004 | Miranda | 704/258 |
| 6,889,186 | B1 * | 5/2005 | Michaelis | 704/225 |
| 6,983,242 | B1 * | 1/2006 | Thyssen | 704/208 |
| 6,992,245 | B2 * | 1/2006 | Kenmochi et al. | 84/622 |
| 6,996,523 | B1 * | 2/2006 | Bhaskar et al. | 704/222 |
| 7,039,581 | B1 * | 5/2006 | Stachurski et al. | 704/205 |
| 7,085,712 | B2 * | 8/2006 | Manjunath | 704/219 |
| 7,089,180 | B2 * | 8/2006 | Heikkinen | 704/220 |
| RE39,336 | E * | 10/2006 | Pearson et al. | 704/258 |
| 7,155,386 | B2 * | 12/2006 | Gao | 704/216 |
| 7,219,065 | B1 * | 5/2007 | Vandali et al. | 704/278 |
| 7,222,070 | B1 * | 5/2007 | Stachurski et al. | 704/207 |
| 7,343,284 | B1 * | 3/2008 | Gazor et al. | 704/226 |
| 7,426,466 | B2 * | 9/2008 | Ananthapadmanabhan et al. | 704/230 |
| 7,756,703 | B2 * | 7/2010 | Lee et al. | 704/209 |
| 2001/0023396 | A1 * | 9/2001 | Gersho et al. | 704/220 |
| 2002/0052734 | A1 * | 5/2002 | Unno et al. | 704/207 |
| 2002/0143527 | A1 * | 10/2002 | Gao et al. | 704/223 |
| 2003/0055633 | A1 * | 3/2003 | Heikkinen | 704/220 |
| 2003/0097254 | A1 * | 5/2003 | Holzrichter et al. | 704/201 |
| 2003/0221542 | A1 * | 12/2003 | Kenmochi et al. | 84/616 |
| 2004/0153316 | A1 * | 8/2004 | Hardwick | 704/214 |
| 2004/0158470 | A1 * | 8/2004 | Kawahara et al. | 704/266 |
| 2005/0010414 | A1 * | 1/2005 | Yamazaki | 704/266 |

OTHER PUBLICATIONS

Kang,G. S. ; Everett,S. E. Improvement of the Narrowband Linear Predictive Coder, 1982. Interim Report Naval Research Lab., Washington, DC. Communications Systems Engineering Branch.*

B. S. Atal,"Predictive coding of speech at low bit rates," IEEE Trans. Commun. vol. COM-30, pp. 600-614, Apr. 1982. 131 C. Galand, M. Rosso. P. Elie, E. Lancon."MPE/LTP speech coder for mobile radio application.". Speech Communication, vol. 7-2, 1988, pp. 167-178.*

Schroeder, M. Atal, B. "Code-excited linear prediction(CELP): High-quality speech at very low bit rates" Publication Date: Apr. 1985 vol. 10, on pp. 937-940.*

Najib Naja, Jean Marc Boucher, Samir Saoudi, "A Mixed Gaussian-Stochastic Code Book for CELP Coder in LSP Speech Coding," Groupe Communications Numeriques, Departement Mathematiques et Systemes de Communications, Brest, France. Oct. 13-16, 1992.*

O. Gottesman and A. Gersho, "Enhanced Waveform Interpolative Coding at 4 kbps", IEEE Speech Coding Workshop, 1999, Finland.*

Gottesmann, O. 1999. Dispersion phase vector quantization for enhancement of waveform interpolative coder. In Proceedings of the Acoustics, Speech, and Signal Processing, 1999. on 1999 IEEE international Conference—vol. 01 (Mar. 15-19, 1999). ICASSP. IEEE Computer Society, Washington, DC, 269-272. DOI= http://dx.doi.org/10.1109/ICASSP.1999.7.*

Shlomot, E.; Cuperman, V.; Gersho, A.; , "Hybrid coding: combined harmonic and waveform coding of speech at 4 kb/s," Speech and Audio Processing, IEEE Transactions on , vol. 9, No. 6, pp. 632-646, Sep. 2001 doi: 10.1109/89.943341 URL: http://ieeexplore.ieee.org/stamp/stamp.jsp?tp=&arnumber=943341&isnumber=20423.*

Kain, A.; Macon, M.W.; , "Design and evaluation of a voice conversion algorithm based on spectral envelope mapping and residual prediction," Acoustics, Speech, and Signal Processing, 2001. Proceedings. (ICASSP '01). 2001 IEEE International Conference on , vol. 2, no., pp. 813-816 vol. 2, 2001 doi: 10.1109/ICASSP.2001.941039.*

Ahmadi, S.; , "An improved residual-domain phase/amplitude model for sinusoidal coding of speech at very low bit rates: a variable rate scheme," Acoustics, Speech, and Signal Processing, 1999. Proceedings., 1999 IEEE International Conference on , vol. 4, no., pp. 2291-2294 vol. 4, Mar. 15-19, 1999 doi: 10.1109/ICASSP.1999.758395.*

Ahmet M Kondoz. Digital speech: coding for low bit rate communication systems, pp. 270-271. 2004. John Wiley & Son Ltd. ISBN 0-470-87077-9.*

Renevey, Philippe / Drygajlo, Andrzej (2001): "Entropy based voice activity detection in very noisy conditions", In EUROSPEECH-2001, 1887-1890.*

Paksoy, E.; McCree, A.; Viswanathan, V.; , "A variable rate multimodal speech coder with gain-matched analysis-by-synthesis," Acoustics, Speech, and Signal Processing, 1997. ICASSP-97., 1997 IEEE International Conference on , vol. 2, no., pp. 751-754 vol. 2, Apr. 21-24, 1997 doi: 10.1109/ICASSP.1997.596031.*

Yang, H.; van Vuuren, S.; Hermansky, H.; , "Relevancy of time-frequency features for phonetic classification measured by mutual information," Acoustics, Speech, and Signal Processing, 1999. ICASSP '99. Proceedings., 1999 IEEE International Conference on , vol. 1, no., pp. 225-228 vol. 1, Mar. 15-19, 1999 doi: 10.1109/ICASSP.1999.758103.*

Pitton, J.W.; Atlas, L.E.; Loughlin, P.J.; , "Applications of positive time-frequency distributions to speech processing," Speech and Audio Processing, IEEE Transactions on , vol. 2, No. 4, pp. 554-566, Oct. 1994 doi: 10.1109/89.326614 URL: http://ieeexplore.ieee.org/stamp/stamp.jsp?tp=&arnumber=326614&isnumber=7749.*

Saito, Shuzo. Speech science and technology. IOS Press, 1991. pp. 270, 272-275.*

* cited by examiner

SPEECH SYNTHESIS USING COMPLEX SPECTRAL MODELING

CROSS-REFERENCE TO RELATED APPLICATION

This application is a continuation-in-part of U.S. patent application Ser. No. 10/243,580, filed Sep. 13, 2002 now U.S Pat. No. 7,127,389, and published as U.S. patent application Publication US 2004/0054526 A1, whose disclosure is incorporated herein by reference.

FIELD OF THE INVENTION

The present invention relates generally to processing and generation of speech signals, and specifically to methods and systems for efficient, high-quality text-to-speech conversion.

BACKGROUND OF THE INVENTION

Effective text-to-speech (TTS) conversion requires not only that the acoustic TTS output be phonetically correct, but also that it faithfully reproduce the sound and prosody of human speech. When the range of phrases and sentences to be reproduced is fixed, and the TTS converter has sufficient memory resources, it is possible simply to record a collection of all of the phrases and sentences that will be used, and to recall them as required. This approach is not practical, however, when the text input is arbitrarily variable, or when speech is to be synthesized by a device having only limited memory resources, such as an embedded speech synthesizer in a mobile computing or communication device, for example.

Concatenative TTS synthesis has been developed in order to synthesize high-quality speech from an arbitrary text input. For this purpose, a large database is created, containing speech segments in a variety of different phonetic contexts. For any given text input, the synthesizer then selects the optimal segments from the database. The "optimal" segments are generally those that, when concatenated with the previous segments, provide the appropriate phonetic output with the least discontinuity and best match the required prosody. For example, U.S. Pat. No. 5,740,320, whose disclosure is incorporated herein by reference, describes a method of text-to-speech synthesis by concatenation of representative phoneme waveforms selected from a memory. The representative waveforms are chosen by clustering phoneme waveforms recorded in natural speech, and selecting the waveform closest to the centroid of each cluster as the representative waveform for the cluster.

In some systems, the encoding of speech segments in the database and the selection of segments for concatenation are based on a feature representation of the speech, such as mel-frequency cepstral coefficients (MFCCs). (These coefficients are computed by integration of the spectrum of the recorded speech segments over triangular bins on a mel-frequency axis, followed by log and discrete cosine transform operations.) Methods of feature-based concatenative speech synthesis are described, for example, in U.S. Pat. No. 6,725,190 and in U.S. patent application Publication US 2001/0056347 A1, whose disclosures are incorporated herein by reference. Further aspects of concatenative speech synthesis are described in U.S. Pat. Nos. 4,896,359, 5,165,008, 5,751,907, 5,913,193, and 6,041,300, whose disclosures are also incorporated herein by reference.

A number of TTS products using concatenative speech generation methods are now commercially available. These products generally use a large speech database (typically 100 MB-1 GB) in order to avoid auditory discontinuities and produce pleasant-sounding speech with widely-variable pitch. For some applications, however, this memory requirement is excessive, and new TTS techniques are needed in order to reduce the database size without compromising the quality of synthesized speech. Chazan et al. describe work directed toward this objective in a paper entitled "Reducing the Footprint of the IBM Trainable Speech Synthesis System," in ICSLP—2002 *Conference Proceedings* (Denver, Colo.), pages 2381-2384, which is incorporated herein by reference.

SUMMARY OF THE INVENTION

Embodiments of the present invention provide improved methods and systems for spectral modeling and synthesis of speech signals. These methods provide faithful parametric models of input speech segments by encoding a richer range of spectral information than in methods known in the art. Specifically, in some embodiments of the present invention, the speech database contains not only amplitude information, but also phase spectral information regarding encoded segments. The combination of amplitude and phase information permits TTS systems to generate high-quality output speech even when the size of the segment database is substantially reduced relative to systems known in the art. The methods of the present invention may also be used in low-bit-rate speech encoding.

In some embodiments of the present invention, a frequency-domain speech encoder divides an input speech stream into time windows, referred to herein as "frames." The encoder processes each frame in the frequency domain in order to compute a vector of model parameters, based on the spectral characteristics of the frame. The encoder distinguishes between voiced and unvoiced frames and applies different analysis techniques to these two types of frames. For voiced frames, the encoder determines the pitch frequency of the frame, and then determines the model parameters based on the harmonics of the pitch frequency. While the model parameters for unvoiced frames may be based solely on analyzing the amplitude spectrum of these frames, for voiced frames the encoder analyzes both the amplitude spectrum and the phase spectrum.

In some of these embodiments, the model vectors are stored in a segment database for use by a speech synthesizer. The speech synthesizer applies the phase model parameters in computing and aligning the phases of at least some of the frequency components of voiced frames. Optionally, the speech synthesizer introduces harmonic frequency jittering of the higher-frequency components in order to avoid "buzz" and to generate more pleasant, natural-sounding speech. Unvoiced frames are typically generated with random phase. Further aspects of the use of phase information to improve sound quality in encoding and decoding of speech are described in the above-mentioned U.S. Patent Application Publication US 2004/0054526 A1.

In some embodiments of the present invention, phase information is extracted and used not only for voiced frames, but also for unvoiced frames that contain "clicks." Clicks are identified by non-Gaussian behavior of the speech signal amplitude in a given frame, which is typically (but not exclusively) caused by a stop consonant (such as P, T, K, B, D and G) in the frame. The speech encoder distinguishes clicks from other unvoiced frames and computes phase spectral model parameters for click frames, in a manner similar to the processing of voiced frames. The phase information may then be used by the speech synthesizer in more faithfully reproducing the clicks in synthesized speech, so as to produce sharper, clearer auditory quality.

There is therefore provided, in accordance with an embodiment of the present invention, a method for processing a speech signal, including:

dividing the speech signal into a succession of frames;

identifying one or more of the frames as click frames;

extracting phase information from the click frames; and encoding the speech signal using the phase information.

In some embodiments, encoding the speech signal includes creating a database of speech segments, and the method includes synthesizing a speech output using the database. Typically, synthesizing the speech output includes aligning a phase of the click frames in the speech output using the phase information.

In a disclosed embodiment, identifying the one or more of the frames as click frames includes analyzing a probability distribution of the frames, and identifying the click frames based on a property of the probability distribution. In one embodiment, analyzing the probability distribution includes computing an entropy of the frames.

There is also provided, in accordance with an embodiment of the present invention, a method for processing a speech signal, including:

dividing the speech signal into a succession of frames;

identifying some of the frames as unvoiced frames;

processing the unvoiced frames to identify one or more click frames among the unvoiced frames; and encoding the speech signal by applying a first modeling method to the click frames and a second modeling method, different from the first modeling method, to the unvoiced frames that are not click frames.

Typically, the first modeling method includes extracting phase information from the click frames.

There is additionally provided, in accordance with an embodiment of the present invention, a method for processing a speech signal, including:

dividing the speech signal into a succession of frames;

identifying some of the frames as voiced frames;

modeling a phase spectrum of each of at least some of the voiced frames as a linear combination of basis functions covering different, respective frequency channels, wherein the model parameters correspond to respective coefficients of the basis functions; and encoding the speech signal using the modeled phase spectrum.

Typically, the method also includes modeling an amplitude spectrum of each of the at least some of the voiced frames, wherein encoding the speech signal includes encoding the modeled phase and amplitude spectra. In disclosed embodiments, the method includes identifying other frames as unvoiced frames, and modeling the amplitude spectrum of each of at least some of the unvoiced frames, wherein encoding the speech signal includes encoding the modeled amplitude spectra of the at least some of the unvoiced frames. In one embodiment, identifying the other frames as unvoiced frames includes identifying a subset of the unvoiced frames as click frames, and the method includes modeling the phase spectrum of each of at least some of the click frames, wherein encoding the speech signal includes encoding the modeled phase spectra of the at least some of the click frames.

In one embodiment, modeling the phase spectrum includes differentially adjusting the respective frequency channels of the basis functions responsively to an amplitude spectrum of the at least some of the voiced frames. Additionally or alternatively, modeling the phase spectrum includes aligning and unwrapping respective phases of frequency components of the phase spectrum before computing the model parameters.

In some embodiments, encoding the speech signal includes creating a database of speech segments, and including synthesizing a speech output using the database, wherein generating the speech output includes aligning phases of the voiced frames in the speech output using the modeled phase spectrum.

There is further provided, in accordance with an embodiment of the present invention, a method for processing a speech signal, including:

dividing the speech signal into a succession of frames;

identifying some of the frames as voiced frames;

computing a time-domain model of a phase spectrum of each of at least some of the voiced frames; and encoding the speech signal using the modeled phase spectrum.

In a disclosed embodiment, computing the time-domain model includes computing a vector of model parameters representing time-domain components of the phase spectrum of a first voiced frame in a segment of the speech signal, and determining one or more elements of the vector to update so as to represent the phase spectrum of at least a second voiced frame, subsequent to the first voiced frame in the segment.

There is moreover provided, in accordance with an embodiment of the present invention, a method for synthesizing speech, including:

receiving spectral model parameters with respect to a voiced frame of the speech to be synthesized, the parameters including high-frequency parameters and low-frequency parameters;

determining a pitch frequency of the voiced frame;

applying the low-frequency parameters to one or more low harmonics of the pitch frequency in order to generate a low-frequency speech component;

applying the high-frequency parameters to one or more high harmonics of the pitch frequency while applying a frequency jitter to the high harmonics in order to generate a high-frequency speech component; and combining the low- and high-frequency components of the voiced frame into a sequence of frames of the speech in order to generate an output speech signal.

There is furthermore provided, in accordance with an embodiment of the present invention, apparatus for processing a speech signal, including a speech processor, which is arranged to divide the speech signal into a succession of frames, to identify one or more of the frames as click frames, to extract phase information from the click frames, and to encode the speech signal using the phase information.

There is also provided, in accordance with an embodiment of the present invention, apparatus for synthesizing a speech signal, including:

a memory, which is arranged to store a database of speech segments, each segment including a succession of frames, such that at least some of the frames are identified as click frames, and the database includes encoded phase information with respect to the click frames; and a speech synthesizer, which is arranged to synthesize a speech output including one or more of the click frames using the encoded phase information in the database.

There is additionally provided, in accordance with an embodiment of the present invention, apparatus for processing a speech signal, including a speech processor, which is arranged to divide the speech signal into a succession of frames, to identify some of the frames as unvoiced frames, to process the unvoiced frames in order to identify one or more click frames among the unvoiced frames, and to encode the speech signal by applying a first modeling method to the click frames and a second modeling method, different from the first modeling method, to the unvoiced frames that are not click frames.

There is further provided, in accordance with an embodiment of the present invention, apparatus for processing a speech signal, including a speech processor, which is arranged to divide the speech signal into a succession of frames, to identify some of the frames as voiced frames, to model a phase spectrum of each of at least some of the voiced frames as a linear combination of basis functions covering different, respective frequency channels, wherein the model parameters correspond to respective coefficients of the basis functions, and to encode the speech signal using the modeled phase spectrum.

There is moreover provided, in accordance with an embodiment of the present invention, apparatus for processing a speech signal, including a speech processor, which is arranged to divide the speech signal into a succession of frames, to identify some of the frames as voiced frames, to compute a time-domain model of a phase spectrum of each of at least some of the voiced frames, and to encode the speech signal using the modeled phase spectrum.

There is furthermore provided, in accordance with an embodiment of the present invention, apparatus for synthesizing a speech signal, including:

a memory, which is arranged to store a database of speech segments, each segment including a succession of frames, such that at least some of the frames are identified as voiced frames, and the database includes an encoded model of a phase spectrum of each of at least some of the voiced frames; and a speech synthesizer, which is arranged to synthesize a speech output including one or more of the voiced frames using the encoded model of the phase spectrum in the database.

There is also provided, in accordance with an embodiment of the present invention, apparatus for synthesizing speech, including:

a memory, which is arranged to store spectral model parameters with respect to a voiced frame of the speech to be synthesized, the parameters including high-frequency parameters and low-frequency parameters; and a speech synthesizer, which is arranged to determine a pitch frequency of the voiced frame, to apply the low-frequency parameters to one or more low harmonics of the pitch frequency in order to generate a low-frequency speech component, to apply the high-frequency parameters to one or more high harmonics of the pitch frequency while applying a frequency jitter to the high harmonics in order to generate a high-frequency speech component, and to combine the low- and high-frequency components of the voiced frame into a sequence of frames of the speech in order to generate an output speech signal.

There is additionally provided, in accordance with an embodiment of the present invention, a computer software product for processing a speech signal, the product including a computer-readable medium in which program instructions are stored, which instructions, when read by a computer, cause the computer to divide the speech signal into a succession of frames, to identify one or more of the frames as click frames, to extract phase information from the click frames, and to encode the speech signal using the phase information.

There is further provided, in accordance with an embodiment of the present invention, a computer software product for synthesizing a speech signal, the product including a computer-readable medium in which program instructions are stored, which instructions, when read by a computer, cause the computer to access a database of speech segments, each segment including a succession of frames, such that at least some of the frames are identified as click frames, and the database includes encoded phase information with respect to the click frames, and to synthesize a speech output including one or more of the click frames using the encoded phase information in the database.

There is moreover provided, in accordance with an embodiment of the present invention, a computer software product for processing a speech signal, the product including a computer-readable medium in which program instructions are stored, which instructions, when read by a computer, cause the computer to divide the speech signal into a succession of frames, to identify some of the frames as unvoiced frames, to process the unvoiced frames in order to identify one or more click frames among the unvoiced frames, and to encode the speech signal by applying a first modeling method to the click frames and a second modeling method, different from the first modeling apparatus, to the unvoiced frames that are not click frames.

There is furthermore provided, in accordance with an embodiment of the present invention, a computer software product for processing a speech signal, the product including a computer-readable medium in which program instructions are stored, which instructions, when read by a computer, cause the computer to divide the speech signal into a succession of frames, to identify some of the frames as voiced frames, to model a phase spectrum of each of at least some of the voiced frames as a linear combination of basis functions covering different, respective frequency channels, wherein the model parameters correspond to respective coefficients of the basis functions, and to encode the speech signal using the modeled phase spectrum.

There is also provided, in accordance with an embodiment of the present invention, a computer software product for processing a speech signal, the product including a computer-readable medium in which program instructions are stored, which instructions, when read by a computer, cause the computer to divide the speech signal into a succession of frames, to identify some of the frames as voiced frames, to compute a time-domain model of a phase spectrum of each of at least some of the voiced frames, and to encode the speech signal using the modeled phase spectrum.

There is additionally provided, in accordance with an embodiment of the present invention, a computer software product for synthesizing a speech signal, the product including a computer-readable medium in which program instructions are stored, which instructions, when read by a computer, cause the computer to access a database of speech segments, each segment including a succession of frames, such that at least some of the frames are identified as voiced frames, and the database includes an encoded model of a phase spectrum of each of at least some of the voiced frames, and to synthesize a speech output including one or more of the voiced frames using the encoded model of the phase spectrum in the database.

There is further provided, in accordance with an embodiment of the present invention, a computer software product for synthesizing speech, the product including a computer-readable medium in which program instructions are stored, which instructions, when read by a computer, cause the computer to read spectral model parameters with respect to a voiced frame of the speech to be synthesized, the parameters including high-frequency parameters and low-frequency parameters, and to determine a pitch frequency of the voiced frame, to apply the low-frequency parameters to one or more low harmonics of the pitch frequency in order to generate a low-frequency speech component, to apply the high-frequency parameters to one or more high harmonics of the pitch frequency while applying a frequency jitter to the high harmonics in order to generate a high-frequency speech component, and to combine the low- and high-frequency components of the voiced frame into a sequence of frames of the speech in order to generate an output speech signal.

The present invention will be more fully understood from the following detailed description of the embodiments thereof, taken together with the drawings in which:

DETAILED DESCRIPTION OF EMBODIMENTS

System Overview

Figure 1:
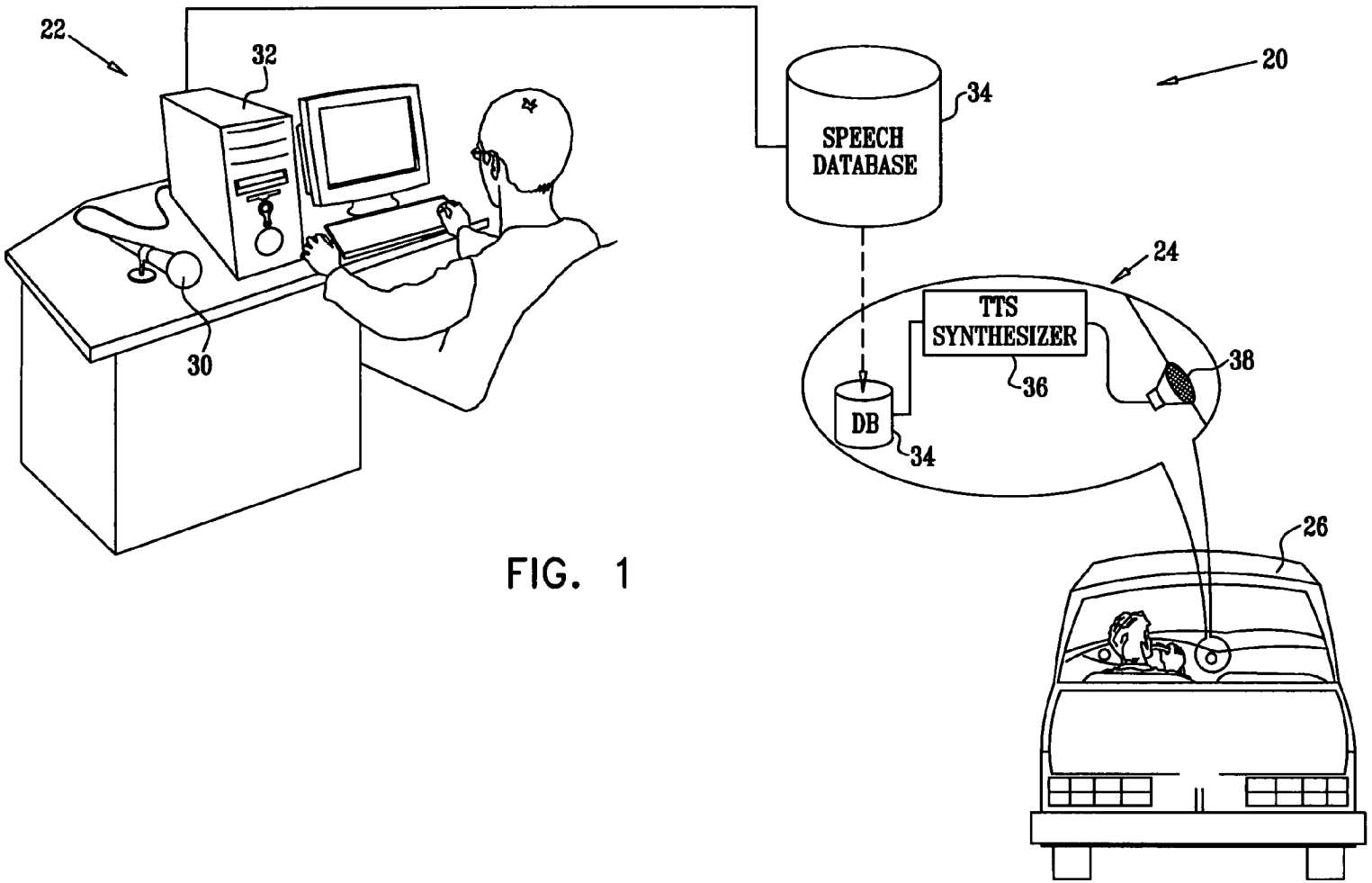
FIG. 1 is a schematic, pictorial illustration of a system for speech encoding and speech synthesis, in accordance with an embodiment of the present invention.

FIG. 1 is a schematic, pictorial illustration of a system 20 for encoding and synthesis of speech signals, in accordance with an embodiment of the present invention. The system comprises two separate units: an encoding unit 22 and a synthesis unit 24. In the example shown in FIG. 1, synthesis unit 24 is a mobile device, which is installed in a vehicle 26 and is therefore constrained in terms of processing power and memory size. Embodiments of the present invention are useful particularly in providing faithful, natural-sounding reconstruction of human speech subject to these constraints. This configuration is shown only by way of example, however, and the principles of the present invention may also be advantageously applied in other, more powerful speech synthesis systems. Furthermore, the principles of the present invention may also be applied in low-bit-rate speech encoding and other applications of automated speech analysis.

Encoding unit 22 comprises an audio input device 30, such as a microphone, which is coupled to an audio processor 32. Alternatively, the audio input to the processor may be provided over a communication line or recalled from a storage device, in either analog or digital form. Processor 32 typically comprises a general-purpose computer programmed with suitable software for carrying out the analysis functions described hereinbelow. The software may be provided to the processor in electronic form, for example, over a network, or it may be furnished on tangible media, such as CD-ROM or non-volatile memory. Alternatively or additionally, processor 32 may comprise a digital signal processor (DSP) or hard-wired logic. Processor 32 analyzes speech input in order to generate a database 34 of speech segments, which are recorded in the database in terms of vectors of spectral parameters. Methods used by processor 32 in computing these vectors are described hereinbelow.

Synthesis unit 24 comprises a text-to-speech (TTS) synthesizer 36, which generates an audio signal to drive an audio output device 38, such as an audio speaker. Synthesizer 36 typically comprises a general-purpose microprocessor or a digital signal processor (DSP), or a combination of such components, which is programmed with suitable software and/or firmware for carrying out the synthesis functions described hereinbelow. As in the case of processor 32, this software and/or firmware may be furnished on tangible media or downloaded to synthesizer 36 in electronic form. Synthesis unit 24 also comprises a stored copy of database 34, which was generated by encoding unit 22. Synthesizer 36 receives an input text stream and processes the text to determine which segment data to read from database 34. The synthesizer concatenates the segment data to generate the audio signal for driving output device 38, as described in detail hereinbelow.

Parametric Modeling of Speech Signals

Figure 2:
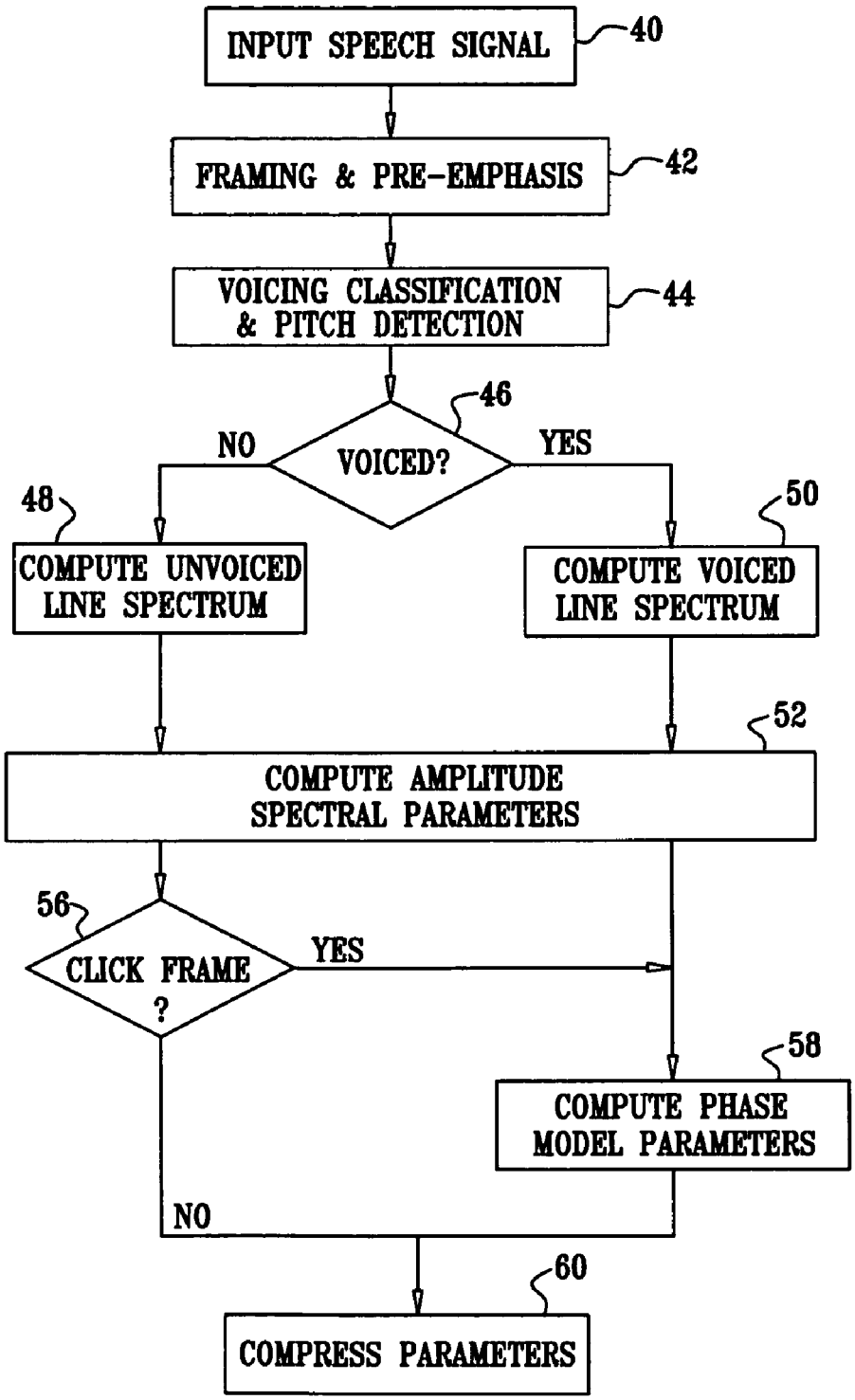
FIG. 2 is a flow chart that schematically illustrates a method for speech encoding, in accordance with an embodiment of the present invention.

FIG. 2 is a flow chart that schematically illustrates a method for processing speech signals using encoding unit 22, in accordance with a preferred embodiment of the present invention. The object of this method is to create a parametric model for the continuous complex spectrum of the speech signal S(f) that satisfies following requirements:

- The model parameters can be robustly estimated from harmonic complex amplitudes (i.e., a line spectrum) given by a frequency transform of the speech signal.
- Samples of the continuous spectral model at the original harmonic frequencies closely approximate the original harmonic complex amplitudes.
- The continuous spectral models produce natural-sounding voiced speech when sampled at any set of modified harmonic frequencies, thus supporting pitch modification in a TTS system.
- The model parameters can be effectively compressed, in order to support low bit-rate speech coding and low-footprint speech synthesis.

For computational convenience in the description that follows, the frequency f is normalized to the sampling frequency (so that the Nyquist frequency is mapped to 0.5, and $0 \leqq f \leqq 0.5$). The complex spectrum is represented in polar form as:

$$S(f)=A(f)\cdot e^{j\cdot\phi(f)} \tag{1}$$

wherein $A(f)=|S(f)|$ and $\phi(f)=\arg(S(f))$ represent the amplitude spectrum and the phase spectrum, respectively.

The method of FIG. 2 begins with an input step 40, at which a speech signal is input from device 30 or from another source and is digitized for processing by audio processor 32 (if the signal is not already in digital form). At a framing step 42, processor 32 performs high-frequency pre-emphasis of the digitized signal S and divides the resulting signal $S_p$ into frames of appropriate duration for subsequent processing. The pre-emphasis is described by the formula: $s_p(n)=s(n)-\lambda s(n-1)$, wherein n is a discrete time variable, and $\lambda$ is a predefined parameter, for example, $\lambda=1$. The signal may be divided into overlapping frames, typically 20 ms long, at intervals of 10 ms between successive frames.

At a voicing classification step 44, processor 32 determines whether the current frame is voiced or unvoiced and computes pitch values for frames that are classified as voiced. Alternatively, voicing may be classified on a continuous scale, between 0 and 1, for example. Methods of pitch estimation and voicing determination are described, for example, in U.S. Pat. No. 6,587,816, whose disclosure is incorporated herein by reference. Voiced and unvoiced frames are treated differently in subsequent processing, as described hereinbelow. In addition, unvoiced frames may typically be classified as either click frames or regular unvoiced frames, as described hereinbelow. Click frames are processed similarly to voiced frames, in that processor 32 extracts both amplitude and phase parameters from the spectrum of each click frame.

Processor 32 next computes the line spectrum of the frame. The line spectrum LS is given by a vector of harmonic frequencies $f_k$ and associated complex spectrum values (harmonic complex amplitudes) $H_k$:

$$LS=\{f_k, H_k\}, k=0, 1, \ldots, N-1 \tag{2}$$

In this equation, N is the number of harmonics located inside the full frequency band determined by the sampling frequency (for example, in the band 0-11 kHz for a 22 kHz sampling rate); $H_k$ are the harmonic complex amplitudes (line spectrum values); and $f_k$ are the normalized harmonic frequencies, $f_k \leqq 0.5$.

The line spectrum is computed differently for voiced frames and unvoiced frames. Therefore, at a voicing decision step 46, the processing flow branches depending on whether the current frame is voiced or unvoiced.

For unvoiced frames, processor 32 computes the line spectrum at an unvoiced spectrum computation step 48. The line spectrum of an unvoiced frame is typically computed by applying a Short Time Fourier Transform (STFT) to the frame. (The STFT is computed by windowing in the time domain followed by Fast Fourier Transform (FFT).) Thus for an unvoiced frame, the harmonic frequencies are defined as $$f_k = \frac{k}{LFFT},$$

and N=LFFT/2, wherein LFFT is the FFT length (for example, N=512 for a typical 22 kHz sampling rate).

For voiced frames, processor 32 computes the line spectrum at a voiced spectrum computation step 50. The harmonic frequencies that are used in computing the line spectrum typically comprise the fundamental (pitch) frequency of the frame and multiples of the pitch frequency. The line spectrum of a voiced frame can be computed by applying a Discrete Fourier Transform (DFT) to a single pitch cycle extracted from the frame window.

In one embodiment, processor 32 computes the line spectrum by deconvolution in the frequency domain. First, processor 32 applies a STFT to the frame, as described above. The processor then computes a vector of complex harmonic amplitudes associated with a set of predefined harmonic frequencies. The processor determines these complex harmonic amplitudes such that the convolution of the vector with the Fourier transform of the windowing function best approximates the STFT in the least-squares sense. The processor may perform this computation, for example, by solving a set of linear equations with a positively-determined sparse matrix. Typically the harmonic frequencies are the multiples of the pitch frequency. In another embodiment, the harmonic frequencies coincide with the local maxima of the STFT amplitudes found in the vicinity of the pitch frequency multiples.

Processor 32 computes amplitude spectral parameters, at an amplitude computation step 52. The underlying parametric model represents a log-amplitude spectrum by a linear combination of basis functions $B_n(f)$, n=1, 2, . . . L:

$$\log(A(f)) = \sum_{n=1}^{L} c_n \cdot B_n(f) \tag{3}$$

Each basis function has a finite support, i.e., it extends over a certain, specific frequency channel. A useful set of basis functions for this purpose is defined, for example, in the above-mentioned U.S. Pat. No. 6,725,190. To generate these basis functions, a monotonic frequency scaling transform $\tilde{f}=F(f)$ is defined, such as the well-known mel-frequency scale. Typically the basis functions are defined so that all the frequency channels have the same width along the $\tilde{f}$ axis, and the adjoining channels corresponding to $B_n$ and $B_{n+1}$ half overlap each other on the $\tilde{f}$ scale. The basis functions may have any suitable shape, such as a triangular shape or a truncated Gaussian shape. In one embodiment, 24 basis functions are used in modeling speech sampled at 11 kHz, and 32 basis functions are used for 22 kHz speech modeling.

The model parameters $c_n$ in equation (3) are determined by minimizing the expression:

$$\min_{\{c\}} \sum_{k=0}^{N-1} \left( \log|H_k| - \sum_{n=1}^{L} c_n \cdot B_n(f_k) \right)^2 \tag{4}$$

The number of parameters (i.e., the number of basis functions, also referred to as the model order) is chosen so that even for high-pitched female voices (characterized by a small number of voiced harmonics), the number of harmonics is greater than the number of parameters. Therefore expression (4) may be solved by applying a least-squares approximation to an overdetermined set of linear equations based on the measured line spectrum $\{H_k\}$.

In some cases, however, the equation matrix computed for a voiced frame may still be nearly singular because the centers of the frequency channels and the pitch frequency multiples are spaced differently along the transformed frequency axis. In order to overcome this problem, processor 32 may resample $\log|H_k|$ evenly on the transformed frequency scale (such as the mel-scale), while interpolating linearly between the original harmonics. The number of the new harmonics thus generated can be adjusted to maintain a predefined level of redundancy in the results. For example, 3L new harmonics, evenly spaced on the mel-frequency scale, may be used in equation (4) instead of the original harmonics.

After processor 32 has computed the model parameters, it determines the energy $$E = \sum_{k=0}^{N-1} |H_k|^2$$

of the frame and uses the energy in computing a normalized set of amplitude spectral parameters:

$$C_k = c_k - \sum_{i=1}^{L} c_i + \frac{\log E}{L} \tag{5}$$

Thus, the energy itself is encoded by the sum of the amplitude parameters:

$$\log E = \sum_{k=1}^{L} C_k .$$

Figure 8:
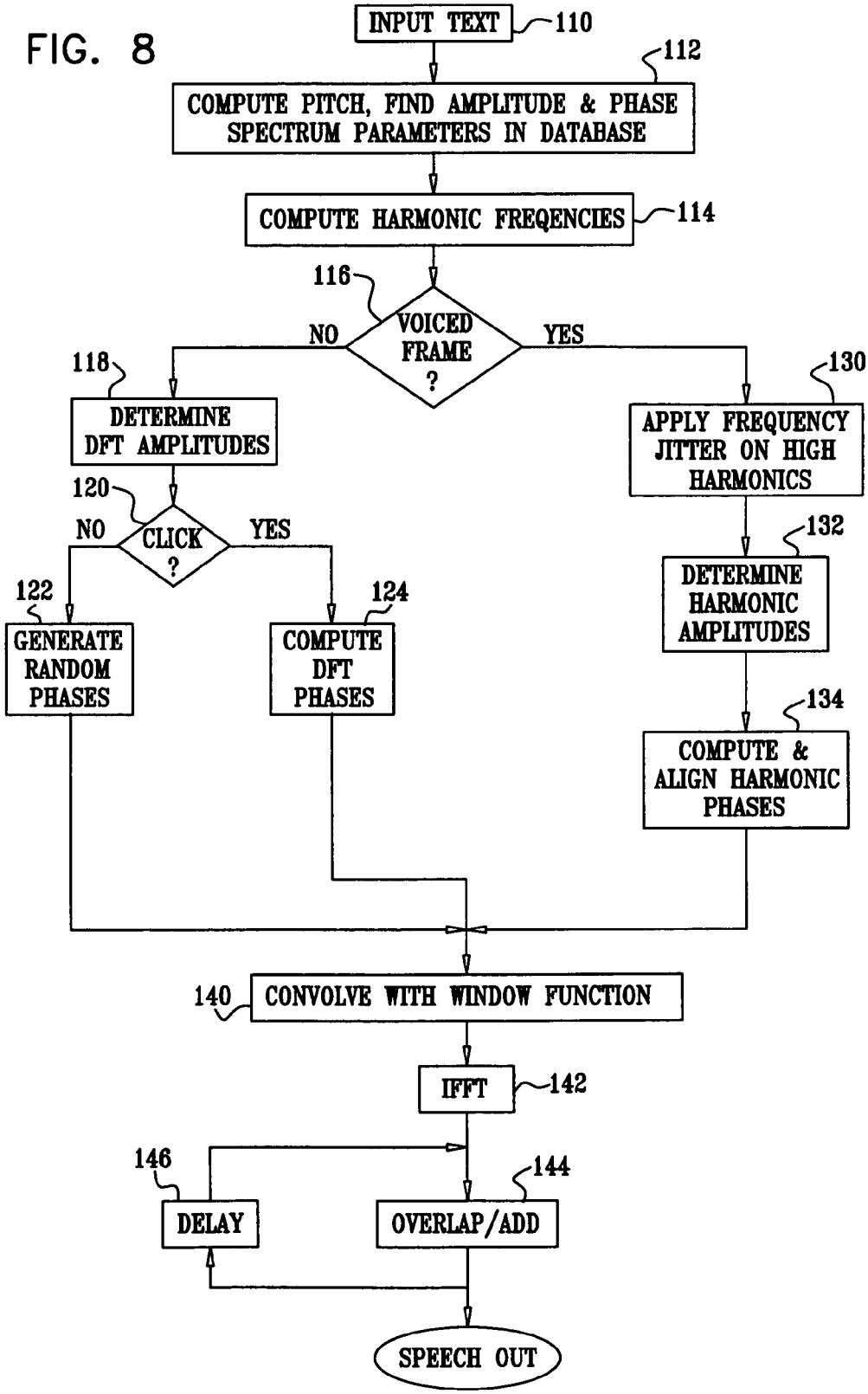
FIG. 8 is a flow chart that schematically illustrates a method for speech synthesis, in accordance with an embodiment of the present invention.

Subsequently, synthesis unit 24 may use the amplitude spectral parameters given by equation (5) not only in the actual speech synthesis, as shown in FIG. 8, but also in searching for segments that may be smoothly concatenated, as described, for example, in the above-mentioned U.S. Patent Application Publication US 2001/0056347 A1.

Unvoiced frames may typically be classified as either click frames or regular unvoiced frames, at a click detection step 56. Details of this step are described hereinbelow with reference to FIG. 4. Click frames are processed similarly to voiced frames, in that processor 32 extracts both amplitude and phase parameters from the spectrum of each click frame.

For each voiced frame, and typically for each unvoiced click frame, as well, processor 32 computes phase model parameters, at a phase computation step 58. Two alternative techniques for this purpose are described hereinbelow:

1. Smooth phase spectrum modeling.
2. Time-domain phase spectrum modeling. These techniques are described with reference to FIGS. 5 and 7, respectively.

When the amplitude and phase model parameters found at steps 52 and 58 are to be used in a low-footprint system, processor 32 compresses the parameters at a compression step 60. In one embodiment, the processor uses a split vector quantization technique, as described, for example, by Gray, in "Vector Quantization," *IEEE ASSP Magazine* (April, 1984), pages 4-29, which is incorporated herein by reference. This sort of compression, combined with the methods for extraction of amplitude and phase model parameters described herein, permits speech to be encoded faithfully at low bit-rates. The inventors have used these methods to encode speech sampled at 22 kHz at a rate of 11 kbps, and to encode speech sampled at 11 kHz at a rate of 8 kbps.

Click Detection

Figure 3A:
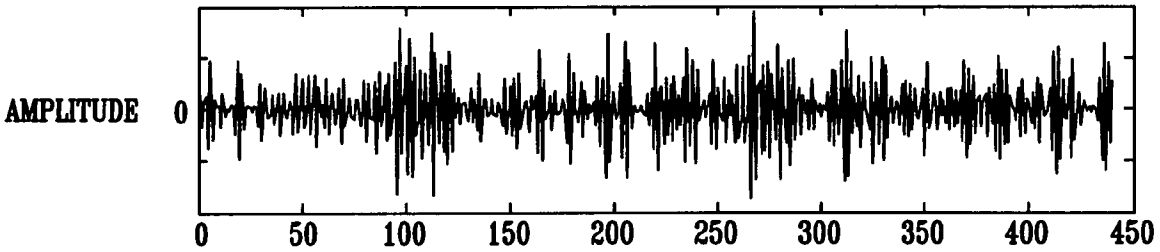
FIG. 3A is a schematic plot of a typical unvoiced speech signal.

FIG. 3A is a schematic plot of the amplitude of a speech signal during a typical unvoiced frame, during which the speaker pronounced an "S" sound. A large majority of unvoiced frames, such as this one, can be modeled by a Gaussian random process. The underlying speech production model is a white noise-like excitation of the vocal tract generated by the vocal cords. The vocal tract colors the white noise excitation process by its frequency-amplitude characteristic. Thus, the corresponding unvoiced fragments of the speech signal are completely described by their power spectrum, as determined at steps 48 and 52. Such unvoiced speech fragments can be synthesized with a random phase spectrum without generating audible distortions.

Figure 3B:
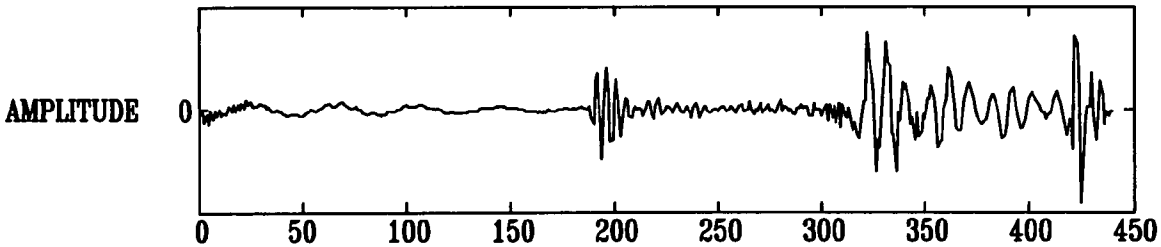
FIGS. 3B and 3C are schematic plots of speech signals containing clicks, in accordance with an embodiment of the present invention.
Figure 3C:
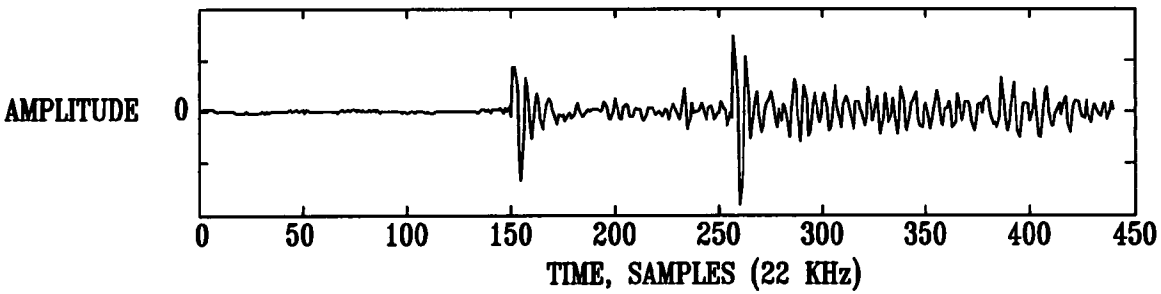

FIGS. 3B and 3C, on the other hand, are schematic plots of speech signal amplitudes during frames that contain clicks. FIG. 3B shows a click preceding a transition from a voiced speech segment to an unvoiced segment, while FIG. 3C shows a click produced by a "T" sound. Typically, clicks correspond to stop consonants like P, T, K, B, D and G, but other types of clicks may also occur, as shown in FIG. 3B. Click segments are characterized by irregular excitation causing audible discontinuities. During click segments of unvoiced speech, the Gaussian model fails, and phase information is desirable for high-quality speech synthesis. An attempt to synthesize clicks as ordinary unvoiced speech, i.e., using randomly-generated phases, leads to smearing of the clicks in time and detracts from the auditory quality of the reconstructed speech signal.

Figure 4:
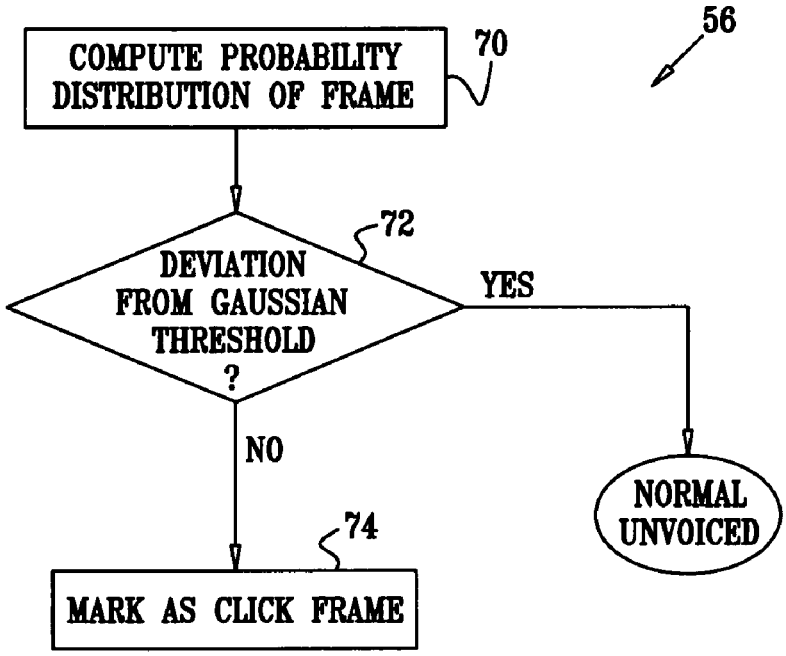
FIG. 4 is a flow chart that schematically illustrates a method for detecting clicks in a speech signal, in accordance with an embodiment of the present invention.

FIG. 4 is a flow chart that schematically shows details of click detection step 56, in accordance with an embodiment of the present invention. As illustrated by the examples shown in FIGS. 3B and 3C, different clicks may have very different waveform shapes, such as colored noise modulated by an envelope step function or a random impulse train. Clicks are distinguished from regular unvoiced speech, however, by their non-Gaussian properties. (Because click frames are non-Gaussian, their corresponding phase spectra contain information that may be captured at step 58 for use in speech synthesis.) Therefore, the method of FIG. 4 is based on measuring the departure of the speech waveform within an unvoiced analysis frame from the model of a Gaussian process. Any suitable measure known in the art can be used for this purpose. Alternatively, other signal processing techniques may be used to detect click frames, as will be apparent to those skilled in the art.

Processor 32 applies the method of FIG. 4 to unvoiced frames whose signal level is above a predetermined minimum. The processor determines the degree to which each such frame conforms to the Gaussian model by computing the probability distribution of the frame, at a distribution computation step 70. The probability distribution is typically expressed in terms of a histogram of the sampled amplitude values of the waveform, using a predefined number of equally-spaced bins spanning the dynamic range of the frame. The processor normalizes the histogram by dividing the count associated with each bin by the frame length. The normalized histogram $\{N_i\}$ gives an estimate of the discrete probability distribution function. The histogram is taken over bins $i=0, \ldots, I$, wherein $I=25$ has been found to give good results for speech signals sampled at 22 kHz.

Processor 32 analyzes the probability distribution of the frame in order to determine how different it is from a Gaussian distribution, at a deviation detection step 72. For example, in one embodiment, the processor estimates the probability distribution Excess defined as $M_4/M_2^2$, wherein $M_n$ is the n-th order centered moment. In another embodiment, the processor uses the entropy of the probability distribution as a measure of non-Gaussian behavior. It is well known that among all possible distributions with a given variance, the Gaussian distribution has the highest entropy.

The entropy of the frame, based on the normalized histogram, is given approximately by:

$$\text{Entropy} = -\sum_{i=1}^{l} N_i \cdot \log_2(N_i) \tag{6}$$

This entropy estimate is compared to a predefined threshold. If the entropy estimate value is less than the threshold, processor 32 marks the current frame as a click, at a click identification step 74.

Referring back to FIGS. 3A-C, the following entropy values were calculated:

FIG. 3A—entropy=4.04.

FIG. 3B—entropy=2.66.

FIG. 3C—entropy=2.57.

The inventors have found that a threshold value of 2.9 distinguishes well between clicks and regular unvoiced frames.

As noted earlier, each frame defined at step 42 (FIG. 2) overlaps a part of the preceding and succeeding frames. To improve the reliability of click detection, the method described above may be modified to take advantage of this overlap. For this purpose, processor 32 applies the click detection process of FIG. 4 to the later part of the frame. This part is slightly longer than half a frame (typically 65% of the frame width). If a click is detected in this preceding frame, then the current frame and the next frame are marked as click-frames at step 74. Otherwise, processor 32 applies steps 70 and 72 to the entire current frame. Thus, a click is usually represented by a sequence of two or more frames. In general the percentage of the click-frames among all the unvoiced frames does not exceed 10%.

Frequency-Domain Phase Spectrum Modeling

Figure 5:
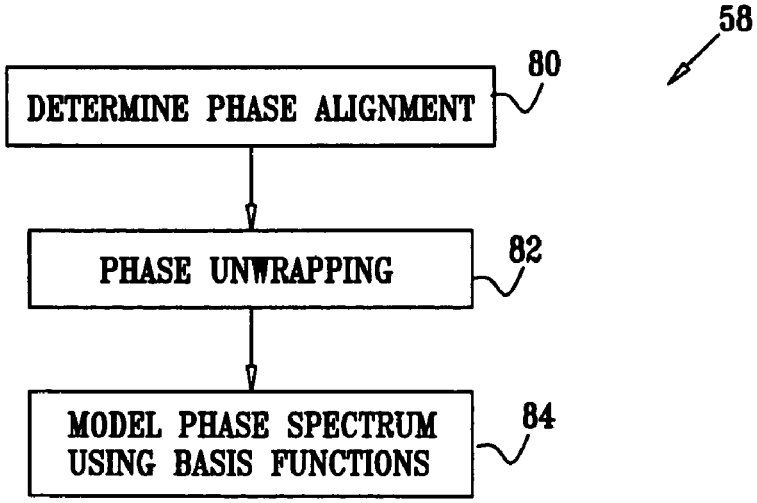
FIG. 5 is a flow chart that schematically illustrates a method for computing phase model parameters of a speech signal, in accordance with an embodiment of the present invention.

FIG. 5 is a flow chart that schematically shows details of phase computation step 58 using smooth phase spectrum (frequency-domain) modeling, in accordance with an embodiment of the present invention. As noted above, this step is applied to voiced frames, as well as to unvoiced click frames. For voiced frames, processor 32 first aligns the phase of the frame, at a phase alignment step 80, by adding a term that is linear in frequency to the phases of the harmonics. In other words, the processor multiplies each complex harmonic amplitude $H_k$ by $\exp(j \cdot 2\pi f_k \cdot \tau_1))$. This operation is equivalent to a time-domain cyclical shift operation and does not change the shape of the signal. In the method of FIG. 5, processor 32 applies absolute alignment to the phases in each voiced frame. In absolute alignment, the parameter $\tau_1$ is computed as described in the above-mentioned U.S. Patent Application Publication US 2004/0054526, so that the average difference between the neighboring harmonic phases is minimal. (Time-domain spectral modeling method, as described below, may use relative phase alignment.)

Phase alignment is followed by phase unwrapping, at an unwrapping step 82. At this step, processor 32 scans the sequence of harmonic phases given by arg $(H_k)$, k=0, 1, . . . , N−1, computed within the interval $(-\pi, \pi]$, and adds to the harmonic phases multiples of $2\pi$ chosen so that the difference between the current and previous unwrapped phase values in the sequence is minimal. If the DC phase arg $H_0$ is equal to $\pi$, then processor 32 subtracts $\pi$ from all the harmonic phases. This subtraction corresponds to inversion of the signal polarity. Finally, processor 32 computes a phase term that is linear in frequency, $l(f_k)=\tau_2 \cdot f_k$, by a least-squares fit to the harmonic phases, and subtracts this term from all the harmonic phases. This unwrapping process results in a set of harmonic phases, $$\phi_k,\ k=0, 1, \ldots, N-1 \tag{7}$$

which is used for the phase model parameters computation.

Processor 32 models the continuous phase spectrum using a linear combination of basis functions $P_n(\tilde{f})$, n=1, 2, . . . , M, at a phase modeling step 84. This modeling process is similar to the method of amplitude modeling used at step 56. The basis functions are defined over a scaled frequency axis $\tilde{f}=F(f)$, wherein F is a positive monotonic frequency transform. The phase spectrum is then expressed as follows in terms of these scaled-frequency basis functions and corresponding phase spectral parameters $d_n$:

$$\varphi(\tilde{f}) = \sum_{n=1}^{M} d_n \cdot P_n(\tilde{f}) \tag{8}$$

Typically, different basis function sets are used for different types of frames. For voiced frames, the basis functions may comprise triangular functions defined over equal and half-overlapping channels along the scaled frequency axis, like those used for amplitude spectrum modeling. Alternatively, the basis functions may comprise sinusoidal functions, such as $P_n=\sin(2\pi n \cdot \tilde{f})$. In an exemplary embodiment, the number of basis functions is M=32 for a 22 kHz sampling rate and M=24 for 11 kHz. The scaling transform F(f) that is used in determining the frequency scale of the basis functions for voiced frames may be a unit transform ($\tilde{f}$=f, no frequency scaling), for example, or a normalized mel transform, such as $\tilde{f}=0.5 \cdot \log_{1+0.5 \cdot s}(1+sf)$ wherein s=SamplingFreq/700. Alternatively or additionally, processor 32 may apply dynamic scaling, as described hereinbelow with reference to FIGS. 6A and 6B. Dynamic scaling may followed by normalized mel-scaling.

For unvoiced click frames, processor 32 may, for example, use the same triangular basis functions as for voiced frames. Because the click frames generally have a flat amplitude spectrum with complex, rapidly-varying phase, however, it is desirable to enlarge the order of the phase model. In one embodiment, the number of basis functions used in modeling click frames is M=64 for a 22 kHz sampling rate and M=32 for 11 kHz. Typically, no frequency scaling is applied in modeling the click frames.

Processor 32 may also accumulate the tangent of the phase angle $\tau=\tau_1+\tau_2$, which is given by the linear term $l(f_k)$ that is subtracted from the harmonic phases at step 82. This additional phase parameter is stored in database 34 together with the basis function coefficients $d_n$ for use in the speech reconstruction process. Use of this additional linear phase term prevents uncontrolled cyclical shifts of the click segments in synthesized speech. This sort of cyclical shift is acceptable for voiced segments, in which the audio signals are periodic, but will cause incorrect waveform evolution in time if it is permitted to occur in click segments. If a constant phase component of $\pi$ was subtracted from the harmonic phases at step 82, then processor 32 may add this component back into the coefficients of the triangular basis functions in order to preserve the original mutual polarity of successive click frames.

Figure 6A:
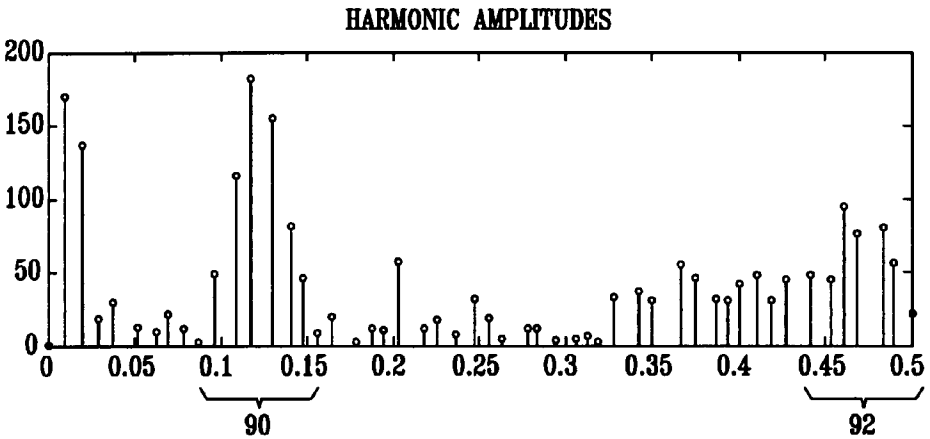
FIG. 6A is a schematic plot of harmonic amplitudes of a speech signal, determined in accordance with an embodiment of the present invention.
Figure 6B:
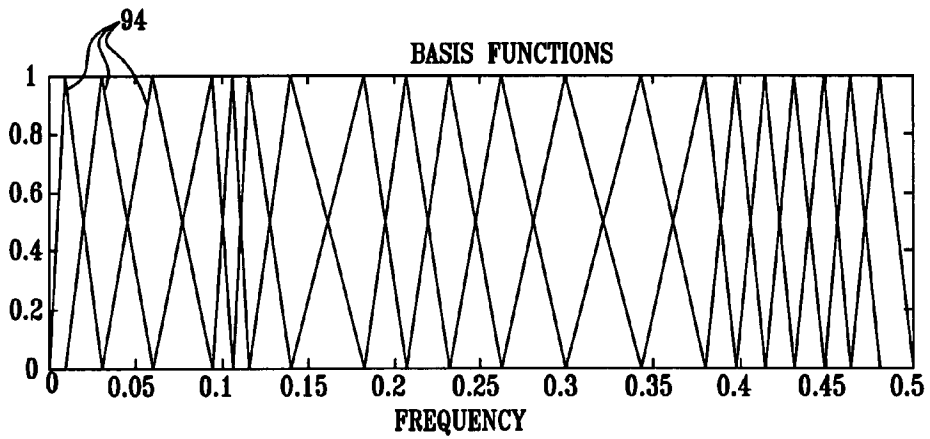
FIG. 6B is a schematic plot of basis functions for use in determining phase spectral model parameters of the speech signal represented by FIG. 6A, in accordance with an embodiment of the present invention.

FIGS. 6A and 6B are schematic spectral plots that illustrate dynamic frequency scaling of the basis functions used at step 84, in accordance with an embodiment of the present invention. Fixed frequency scaling, as described above, may be optimized for representing certain types of sounds, but it may then be sub-optimal for others. For example, log-frequency scaling (such as the above-mentioned mel-scaling) gives good representation of most sounds, in which the low-frequency range dominates. Some sounds (such as the voiced fricatives Z and V), however, have their most energetic spectral components in high-frequency bands. Dynamic frequency scaling overcomes this problem by adjusting the set of basis functions used in modeling the phase spectrum to account for the variations in spectral formant location from sound to sound and from speaker to speaker.

In dynamic frequency scaling, the basis functions used in phase modeling are defined dynamically for each frame according to the amplitude spectrum of the frame. FIG. 6A shows the amplitude spectrum for an exemplary frame as a function of linear frequency. Concentrations of high-amplitude components occur in regions 90 and 92, corresponding to the most energetic parts of the spectrum. FIG. 6B shows basis functions 94 that are determined on the basis of the amplitude spectrum of FIG. 6A. The basis functions have the same overlapping, triangular shape as the equally-spaced basis functions described above. Due to the dynamic frequency scaling, however, the frequency channels of the basis functions are more tightly spaced in regions 90 and 92, thus representing the phase spectrum in these regions with higher resolution.

Formally, the dynamic frequency scale may be defined as follows:

$$\bar{f} = 0.5 \cdot \int_0^f W(A(x))dx \Big/ \int_0^{0.5} W(A(x))dx \tag{9}$$

Here A(f) is the continuous amplitude spectrum given by the parametric model described above: $A(f)=\exp(\Sigma C_k \cdot B_k(f))$. W(.) is a positive monotonic function, such as $W(A)=A^{\lambda}$, wherein $\lambda>0$ is a predefined parameter, for example, $\lambda=0.5$.

Thus, when dynamic frequency scaling is used, the frequency scale used in phase modeling may vary from frame to frame. The same variable scaling is then used by synthesizer 36 (FIG. 1) in reconstructing the phase of synthesized speech. For this purpose, it is not necessary to explicitly store the scaling of each frame, since the scaling can be restored using the amplitude spectrum model parameters $C_k$ stored in database 34. Furthermore, for some basis functions $B_k(f)$ (such as triangular functions) the integral in equation (9) can be expressed analytically in terms of the $C_k$ coefficients, so that the dynamic frequency scaling is easy to compute on the fly.

To estimate the phase model parameters $\{d_n, n=1, \ldots, M\}$ for a given frame, the appropriate frequency scaling is applied to the harmonic frequencies of the frame $\tilde{f}_k=F(f_k)$, k=0, 1, . . . , N−1. The harmonic log-amplitudes $\log|H_k|$ and unwrapped phases $\phi_k$ are then re-sampled evenly over the transformed frequency scale by linear interpolation between their original values to give K modified harmonics. Typically, K>>M, for example, K=3M. The purpose of this re-sampling is to guarantee the stability of the parameter estimation. Thus, re-sampling is not necessary if no frequency scaling is applied (in which case the original harmonics are used in the phase model).

The phase model parameters are obtained by minimization of the expression:

$$\min_{\{d\}} \sum_{k=0}^{K-1} |H_k|^{\alpha} \cdot \left(\phi_k - \sum_{n=1}^{M} d_n \cdot P_n(\bar{f}_k)\right)^2 \tag{10}$$

Here $|H_k|=\exp(\log|H_k|)$ are the re-sampled harmonic amplitudes, and $\phi_k$ are the re-sampled harmonic phases; and $\alpha>0$ is a parameter controlling the additional influence of the spectral amplitude level on the phase approximation accuracy. In an exemplary embodiment, $\alpha=0.25$. The solution to the minimization problem of expression (10) may be found by solving a set of linear equations with a symmetric positively-determined matrix.

Time-Domain Phase Modeling

The time-domain phase modeling technique may be used at step 58 (FIG. 2) in place of the method of FIG. 5. The time-domain technique represents the complex phase spectrum $e^{j\cdot\Phi(f_k)}$ (i.e., the "flat" spectrum, without amplitude variations) as a vector of samples in the time domain, rather then by direct modeling of the phase $\phi(f_k)$. For this purpose, let R□{R(k)□$e^{j\cdot\Phi(f_k)}$, 1≦k≦K}, be the complex phase spectrum to be modeled, wherein K is the number of harmonics in the sinusoidal model representation of the current frame. R(k) may be extracted directly from the complex line spectrum values or, alternatively, after resampling of the flattened line-spectrum in order to reduce the number of harmonics. Processor 32 uses time-domain phase modeling to compute an efficient approximation of a constant-length time-domain phase vector r□{r(n), 0≦n≦N}, such that $$\frac{FFT(r)}{\|FFT(r)\|} \approx R.$$

The time-domain approach has the advantages of not requiring phase unwrapping and of modeling voiced and unvoiced clicks frames identically using the same number of parameters.

Figure 7:
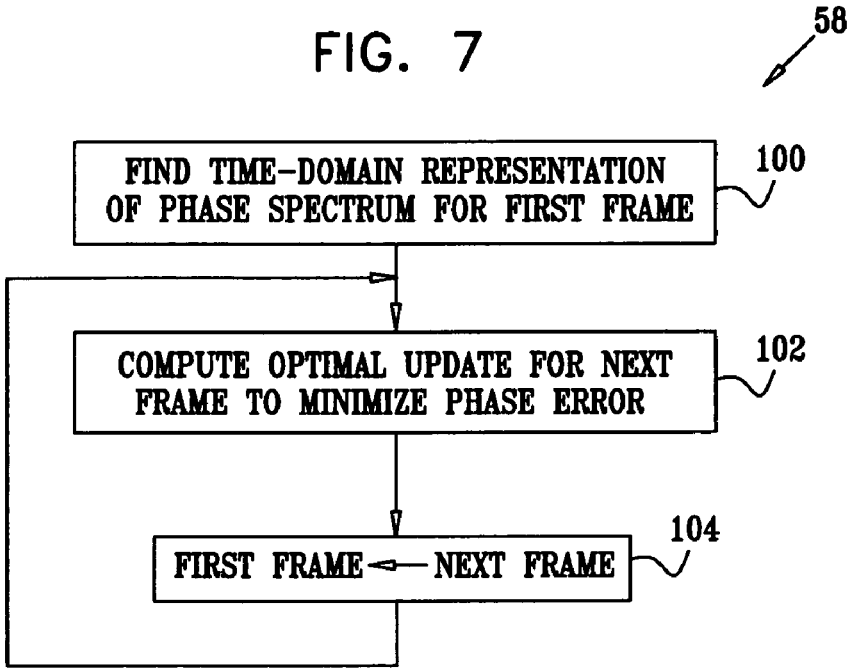
FIG. 7 is a flow chart that schematically illustrates a method for time-domain phase modeling, in accordance with an embodiment of the present invention.

FIG. 7 is a flow chart that schematically illustrates a method for time-domain phase modeling, in accordance with an embodiment of the present invention. This method makes use of the fact that over continuous stationary speech segments, only small changes in the phase spectrum are expected from frame to frame. Therefore, once r is found for an initial frame in a voiced segment, only a few elements r(n) out of the total of N elements must typically be updated subsequently from one frame to the next, and these elements can be updated iteratively.

To carry out the method of FIG. 7, processor 32 finds the constant-length time-domain representation of the phase spectrum for the first frame in the segment to be modeled, at an initial frame modeling step 100. Processor 32 estimates r as $$Mr \approx R \tag{11}$$

by minimizing Re((Mr−R)* W(Mr−R)), wherein M is the DFT transform matrix (not necessarily square) with elements $$m_{k,n} = e^{-j\frac{2\pi}{N}nk},$$

0≦k<K, 0≦n<N; and W is a diagonal weighting matrix containing the amplitude spectral values $|R(k)|^{\alpha}$ on its diagonal, wherein $0<\alpha<1$ is a spectrum compression factor. This minimization is equivalent to finding the least-squares solution of Re(M*WM)r=Re(M*WR), which may be rewritten in cyclic convolution form as:

$$Re(M^*W)\otimes r=Re(M^*WR) \tag{12}$$

The complex phase spectrum for each frame is calculated by rearranging equation (12) and transforming to the frequency domain:

$$\hat{R}=FFT\{Re(M^*WR)\}/FFT\{Re(M^*W)\} \tag{13}$$

Using the notation $\{\ \}_N$ to represent a cyclic wrapping operation $$\left(\{x(k)\}_N \ \square \ \sum_i x(k+Ni),\ 0\le k<N\right), \qquad \text{equation (13)}$$

equation (13) can be rewritten:

$$\hat{R}=\frac{N\times FFT\{Re(IFFT\{WR\}_N)\}}{N\times FFT\{Re(IFFT\{W\}_N)\}} \tag{14}$$

The solution to this equation may be calculated efficiently by noting that N×FFT{Re(IFFT{y(k)})}=N/2(y(k)+y((N−k) mod N)). The time domain solution is then found by performing the inverse Fourier transform of $\hat{R}$.

For each successive frame after the first frame, processor 32 finds an optimal update of the vector r relative to the previous frame vector $r_p$ in order to minimize the error in phase estimation of the current frame, at an update step 102. The processor iterates in this manner through all the frames in a voiced segment, at an iteration step 104. For this purpose, the phase estimation error for the current frame can be written as:

$$\epsilon=Re((Mr_p-R)^*W(Mr_p-R)) \tag{15}$$

At step 102, processor 32 attempts to find the element r(k) ($0\leqq k\leqq N$) in r that when updated by a corresponding factor $\alpha_k$ will result in a maximal reduction of $\epsilon$. In other words, the processor seeks $\alpha_k$ that will minimize the residual error:

$$\epsilon_k=Re((Mr_p+m_k\alpha_k-R)^*W(Mr_p+m_k\alpha_k-R) \tag{16}$$

wherein $m_k$ is the k-th column of the M matrix.

The optimal update for any given element r(k) can be written as:

$$\begin{aligned}\alpha_k^{opt}&=-Re\left\{\frac{(Mr_p-R)^*Wm_k}{m_k^*Wm_k}\right\}\\&=\frac{-Re\{(Mr_p-R)^*Wm_k\}}{tr(W)}\end{aligned} \tag{17}$$

Therefore, the vector of optimal updates $\alpha\square\{\alpha_k^{opt}, 0\leqq k<N\}$ for all the elements of r, can be calculated as:

$$\alpha=\frac{-Re\{M^*WM\}r_p+Re\{M^*WR\}}{tr(W)} \tag{18}$$

This calculation can be performed efficiently using Fourier transforms, as described above. The error improvement for each choice of k is then given by $\Delta\epsilon_k=-(\alpha_k^{opt})^2\,tr(W)$. Therefore, the optimal element to update is:

$$k^{opt}=\arg\max_k(\alpha_k^{opt}) \tag{19}$$

After finding the first update factor $\alpha_k$, processor 32 repeats the computation of equations (18) and (19) to find the next element of r to update in the current frame, continuing iteratively in this fashion until either it has computed a predetermined maximum number of updates or the error (equation (15)) drops below a predefined threshold. The processor then goes on to compute the update factors for the next frame in the segment. Upon conclusion of the process, the elements of the time-domain phase vector r for the first frame and the full vector or update factors for the succeeding frames in the segment are compressed and stored in database 34, where they may be used in subsequent speech synthesis.

In an alternative embodiment, processor 32 computes L best updates at each iteration. Together with the preceding iteration, these L updates give L*L possible tracks, which the processor then prunes to find the L best tracks after each iteration. One of the L best update tracks is chosen at the final iteration.

Scalar quantization of the update values may be incorporated in the above solution for purposes of compression (step 60). Let $\alpha_k^Q=\alpha_k^{opt}+\Delta\alpha_k$ be the result of a scalar quantization of a given update. The error improvement then becomes:

$$\begin{aligned}\Delta\varepsilon_k^Q&=\left(-2\alpha_k^{opt}\alpha_k^Q+(\alpha_k^Q)^2\right)tr(W)\\&=\left(-(\alpha_k^{opt})^2+\Delta\alpha_k^2\right)tr(W)\\&=\Delta\varepsilon_k+\Delta\alpha_k^2\,tr(W)\end{aligned} \tag{20}$$

The optimal choices of elements to update are then determined using $\Delta\epsilon_k^Q$, in the manner of equation (19), as described above.

In an alternative embodiment, the time-domain phase vector r is found by full parameterization of the signal in each individual frame, in the manner described above at step 100.

Speech Synthesis

FIG. 8 is a flow chart that schematically illustrates a method for speech synthesis, in accordance with an embodiment of the present invention. This method makes use, inter alia, of the phase spectral information determined in the embodiments described above, including phase information with respect to click frames. In the present example, the method is implemented in a low-footprint TTS system, such as synthesis unit 24 (FIG. 1). For this purpose, the amplitude and phase spectral information derived above is stored in database 34, where it is accessed as required by synthesizer 36.

Synthesizer 36 receives a text input, at an input step 110. The synthesizer analyzes the text to determine a sequence of speech segments that are to be synthesized and the pitch to be applied to each of the voiced segments, at a text analysis step 112. The pitch for the voiced segments is chosen by the synthesizer and is generally not the same pitch as that at which the segments were recorded by encoding unit 22. The synthesizer looks up the segments in database 34 in order to choose the appropriate sequences of amplitude and phase spectral parameters to use in generating the desired speech stream. Any suitable methods of concatenative speech synthesis may be used in choosing the segments and the corresponding parameters, such as the methods described, for example, in the above-mentioned in U.S. Pat. No. 6,725,190 and U.S. Patent Application Publication US 2001/0056347 A1.

Each segment in the speech stream typically comprises a number of frames. For each frame, synthesizer 36 determines the set of harmonic frequencies to use in reconstructing the amplitude and phase spectra of the frame, at a frequency selection step 114. Typically, for unvoiced frames, the harmonic frequencies are the same frequencies as are used in subsequent DFT computation, with one harmonic frequency for each DFT frequency point. For voiced frames, the harmonic frequencies are chosen as multiples of the pitch frequency. The synthesis process then branches at a voicing determination step 116, after which different synthesis techniques are applied to voiced and unvoiced frames.

For unvoiced frames, synthesizer 36 determines the DFT frequency component amplitudes, at an unvoiced amplitude computation step 118. For this purpose, the synthesizer reads the amplitude spectral parameters for the current frame from database 34 and then computes the amplitude spectrum in accordance with equation (3). The synthesizer scales the amplitude to the energy level that is indicated by the stored parameters. The synthesis process branches again between click frames and regular unvoiced frames, at a click determination step 120. For regular (non-click) unvoiced frames, the synthesizer applies random phases to the DFT frequency components, at a random phase generation step 122.

For click frames, synthesizer 36 reads the corresponding phase spectral parameters from database 34 and applies the corresponding phases to the DFT frequency components, at a click phase computation step 124. Either the frequency-domain (FIG. 5) or the time-domain (FIG. 7) phase parameters may be used at this step. In the case of time domain representation, the phase spectrum is extracted, using equation (11), and the resultant spectrum is flattened to have a unity amplitude. For the frequency domain representation, the synthesizer computes the phases on the appropriate scaled frequency axis using the phase spectral parameters and basis functions in accordance with equation (8). In the frequency domain representation, the synthesizer adds to each of the terms a phase shift that is linear in frequency. The linear phase shift is based on the tangent of the phase angle that was recorded and stored in the database for this frame during encoding at step 84 (FIG. 5), as described above.

For voiced frames, synthesizer 36 applies an intentional frequency jitter to the high harmonics, at a jittering step 130. The purpose of this jitter is to avoid high-frequency buzz that can otherwise occur in synthesis of voiced frames. The added jitter generally gives the synthesized speech a more natural and pleasant-sounding tone. For this purpose, the synthesizer shifts each of the high-frequency harmonics by a randomly-generated frequency offset. In one embodiment, the shifts have a normal distribution with zero mean and with variance increasing with frequency. Alternatively, when a continuous voicing scale is used in encoding frames, the voicing value may be recorded in database 34 for each frame, and the amount of jitter may then be determined as a function of the degree of voicing. Typically, the jitter decreases with the degree of voicing.

Synthesizer 36 reads the amplitude spectral parameters for each voiced frame from database 34 and computes the amplitudes of the frequency components of the frame, at a voiced amplitude computation step 132. The synthesizer then reads the phase spectral parameters from the database and computes the phases of the frame frequency components, at a voiced phase computation step 134. Steps 132 and 134 proceed in similar fashion to steps 118 and 124, using equations (3) and (8). For voiced frames, however, rather than adding a predetermined linear phase shift to the frequency components as for click frames, synthesizer 36 typically chooses a linear phase shift so as to align the phase of the current frame with that of the preceding voiced frame (assuming the previous frame was voiced). This technique is described in detail in the above-mentioned U.S. Patent Application Publication US 2004/0054526 A1. The synthesizer computes for each voiced frame an additional linear phase term corresponding to the time shift of the present frame relative to the preceding frame. The synthesizer applies both of these linear phase terms to the frequency components of the current frame.

After computing the amplitudes and phases of the spectral components of each frame, synthesizer 36 convolves the spectrum of the frame with the spectrum of a window function, at a windowing step 140. For example, the synthesizer may use a Hanning window or any other suitable window function known in the art. The synthesizer transforms the frame to the time domain using an inverse Fast Fourier Transform (IFFT), at a time domain transformation step 142. It then blends successive frames using overlap/add and delay steps 144 and 146, as are known in the art, in order to generate the output speech signal.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method for processing a speech signal, comprising using at least one computer programmed to implement:

dividing the speech signal into a succession of frames;

identifying at least one of the frames as an unvoiced click frame;

identifying at least one of the frames as an unvoiced non-click frame;

identifying at least one of the frames as a voiced frame;

calculating one or more parameters of a model of a phase spectrum of the at least one unvoiced click frame;

storing the parameters of the model of the phase spectrum of the at least one unvoiced click frame in a data set;

applying a first method to the at least one unvoiced click frame and to the at least one unvoiced non-click frame to obtain harmonic representations of the at least one unvoiced click frame and the at least one unvoiced non-click frame; and applying a second method, different from the first method, to the at least one voiced frame to obtain an harmonic representation of the at least one voiced frame, wherein identifying the at least one of the frames as the at least one unvoiced click frame comprises:

identifying the at least one of the frames as an unvoiced frame; and processing the at least one unvoiced frame by:

analyzing a probability distribution of the at least one unvoiced frame, finding a deviation of the probability distribution of the at least one unvoiced frame from a Gaussian distribution, and identifying the at least one unvoiced frame as the at least one unvoiced click frame if the deviation exceeds a predefined threshold.

2. The method of claim 1, further comprising:

calculating parameters of a model of a phase spectrum of the at least one voiced frame; and storing the parameters of the model of the phase spectrum of the at least one voiced frame in a data set.

3. The method of claim 2, further comprising:

calculating parameters of models of amplitude spectra of the at least one unvoiced click frame, the at least one unvoiced non-click frame, and the at least one voiced frame, respectively;

storing the parameters of the models of the amplitude spectra of the at least one unvoiced click frame, the at least one unvoiced non-click frame, and the at least one voiced frame in a data set.

4. The method of claim 3, wherein the models of the phase spectra of the at least one unvoiced click frame and the at least one voiced frame are continuous complex phase spectrum models.

5. The method of claim 4, wherein identifying the at least one of the frames as the at least one unvoiced non-click frame comprises determining that the at least one unvoiced non-click frame has a random phase spectrum.

6. The method of claim 2, wherein calculating the parameters of the model of the phase spectrum of the at least one unvoiced click frame comprises using smooth phase spectrum modeling;

calculating the parameters of the model of the phase spectrum of the at least one voiced frame comprises using smooth phase spectrum modeling; and using smooth phase spectrum modeling comprises:

using a linear combination of basis functions to model a phase spectrum of a frame, and aligning and unwrapping respective phases of frequency components of the phase spectrum of the frame before calculating the parameters of the model of the phase spectrum of the frame.

7. The method of claim 2, wherein the model of the phase spectrum of the at least one voiced frame is a time-domain phase spectrum model.

8. The method of claim 1, wherein the model of the phase spectrum of the at least one unvoiced click frame is a continuous complex phase spectrum model.

9. The method of claim 1, wherein processing the at least one unvoiced frame to identify the at least one unvoiced click frame occurs only if a signal level of the at least one unvoiced frame exceeds a predetermined minimum.

10. The method of claim 1, wherein analyzing the probability distribution of the at least one unvoiced frame comprises representing the probability distribution as a histogram of sampled amplitude values of a waveform associated with the at least one unvoiced frame.

11. The method of claim 1, wherein finding the deviation of the probability distribution of the at least one unvoiced frame from a Gaussian distribution comprises estimating an excess of the probability distribution, the excess being equal to a fourth-order centered moment of the probability distribution divided by a square of a second-order centered moment of the probability distribution.

12. The method of claim 1, wherein finding the deviation of the probability distribution of the at least one unvoiced frame from a Gaussian distribution comprises calculating an entropy of the probability distribution.

13. The method of claim 12, wherein the deviation exceeds the predefined threshold if the entropy is less than 2.9.

14. The method of claim 1, wherein analyzing the probability distribution of an unvoiced frame comprises analyzing a probability distribution of a latter part of the unvoiced frame, and processing the unvoiced frame further comprises identifying a next frame as an unvoiced click frame if the deviation exceeds the predefined threshold.

15. The method of claim 1, wherein the model of the phase spectrum of the at least one unvoiced click frame represents respective phases of the speech signal at a plurality of frequencies.

* * * * *